United States Patent [19]

Carle et al.

[11] 4,304,338

[45] Dec. 8, 1981

[54] CENTER-OF-CAR CUSHIONING DEVICE WITH GAS RETURN

[75] Inventors: Ross G. Carle, Westchester; Charles L. Van Auken, New Cumberland, both of Pa.

[73] Assignee: Keystone Industries, Inc., Rolling Meadows, Ill.

[21] Appl. No.: 89,550

[22] Filed: Oct. 29, 1979

[51] Int. Cl.[3] ..... B61G 9/08; B61G 9/16

[52] U.S. Cl. ..... 213/8; 213/43

[58] Field of Search ..... 213/8, 43, 223, 64, 213/67, 69; 267/64 R, 65 R, 115, 118

[56] References Cited

U.S. PATENT DOCUMENTS 3,776,391 12/1973 Hawthorne ..... 213/8

3,913,748 10/1975 Carle ..... 213/8

*Primary Examiner*—Richard A. Bertsch

*Attorney, Agent, or Firm*—Leydig, Voit, Osann, Mayer & Holt, Ltd.

[57] ABSTRACT

A cushion assembly having an outer cylinder and a metering cylinder extending between end caps and defining an annular reservoir therebetween with communication being provided by metering orifices distributed along the length of the metering cylinder. A piston is slideable in the metering cylinder having a first piston rod connected to one side and a second piston rod of hollow construction connected to the other side, the first piston rod having a head at its outer end. The head and the first end cap define a gap between them when the first piston rod is in its contracted state. Stop members on the slideable sill and frame of the car occupy normal side by side positions in register with one another in the gap, so that a shock applied to the sill in either direction causes the stop members to shift out of register with one another elongating the gap so as to tension and extend the first piston rod. The device is charged with a combination of hydraulic fluid and gas under pressure so that as the piston moves fluid restrictedly flows through the orifices from a position in front of the piston through the reservoir to a position behind the piston to cushion the shock, the second piston rod having a substantially greater diameter than the first, presenting a greater axially projected area to the pressurized fluid, so that the piston is promptly returned to its retracted state in readiness for a subsequent shock.

8 Claims, 10 Drawing Figures

CENTER-OF-CAR CUSHIONING DEVICE WITH GAS RETURN

Cushioning devices have long been used in association with railroad car couplings to absorb shock and thereby reduce the possibility of damage to the lading. In long railroad cars separate cushioning devices are usually provided at each coupling. In the case of cars of shorter or conventional length a single cushioning device is used. In such installations a longitudinal force-transmitting member referred to as a sliding sill extends the length of the car and carries the car couplings at its ends. The single cushioning device is located at the center of the car interposed between the sill and the car frame. One advantage of the sliding sill is that the coupling forces are largely isolated from the car structure resulting in greater protection of the lading. One factor in use of the sliding sill is that there is no cushioning of "train action," but this is not really a disadvantage since, with a sliding sill, train action is inherently minimized since the only "run-in" and "run-out" is limited to the accumulative play in the couplings themselves.

In prior Hawthorne U.S. Pat. No. 3,776,391 which issued Dec. 4, 1973 there is shown a center-of-car cushioning assembly employing a cylinder having metering orifices to restrict the flow of hydraulic fluid for cushioning of shock, with the piston being restored to its initial position by means of a restoring spring. In prior U.S. Pat. No. 3,913,748, of which Carle is patentee, and which issued Oct. 21, 1975, the cylinder does not perform any metering function and, instead, hydraulic fluid passes from one side of the piston to the other directly through a bypass opening in the piston, the cross section of the opening being varied as a function of stroke. In the cushioning device there described the return spring is replaced by a column of compressed gas with a floating piston to isolate the column of gas from the hydraulic fluid. Any intermixing due to leakage tends to degrade the performance of that type of device.

The devices disclosed in the above patents, typically of the prior art, are relatively complex, expensive to manufacture, and require adherence to close tolerances. The devices are inherently rather heavy yet in some respects fragile, requiring a high degree of care during shipment and installation. Partly due to the multiplicity of parts reliability has left something to be desired.

It is an object of the present invention to provide a car cushioning assembly which is highly reliable and long-lived and which is inherently simpler, more easily assembled and more economical than prior constructions. It is a related object to provide a car cushioning assembly which is more easily fabricated and assembled and which produces consistent results without adherence to extremely accurate tolerances. It is another related object to provide a car cushioning device which, for a given capacity, can be made lighter in weight than prior constructions yet of greater durability.

It is another object of the present invention to provide a cushioning assembly of the gas-returned type and which therefore avoids the expense of a return spring but which does not require that the pressurized gas and hydraulic fluid be kept separate from one another; on the contrary, the gas and the hydraulic fluid are combined in the same compartments, with the mixture of the two resulting in improved cushioning characteristics. It is a further object to provide a cushioning device in which, for a given size, achieves a greater returning or restoring force than is possible in more conventional designs.

It is another object of the invention in one of its aspects to provide a cushioning device which is more easily installed even though mounted in a poorly accessible portion of the car frame and in which the movable parts are more adequately protected from the corrosive action of moisture and the elements, and accumulation of dirt, resulting in long life without need for frequent inspection or maintenance while, at the same time, minimizing the need to use special anti-corrosion plating or finishing.

Other objects and advantages of the invention will become apparent upon reading the attached detailed description and upon reference to the drawings in which.

Figures 3, 4, 5, 5A, 5B:
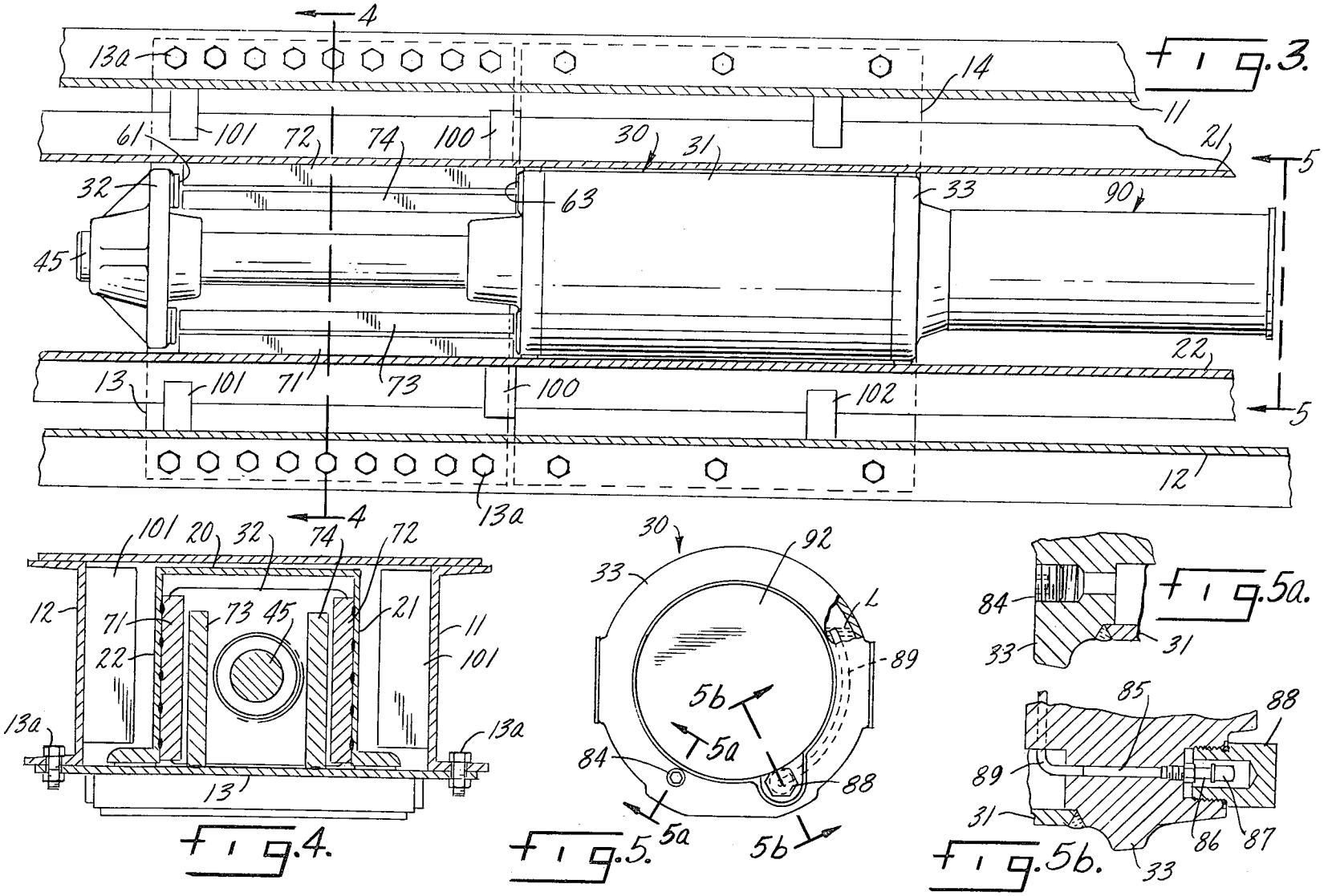
FIG. 3 is a plan view of the cushioning device of FIGS. 1 and 2 with portions in section.
FIG. 4 is a transverse section taken along line 4—4 of FIG. 3.
FIG. 5 is an end view of the cushioning assembly looking along line 5—5 in FIG. 3.

FIGS. 5*a* and 5*b* are fragmentary sections taken along correspondingly numbered section lines in FIG. 5 showing the respective fluid and gas fill openings.

Figure 6:
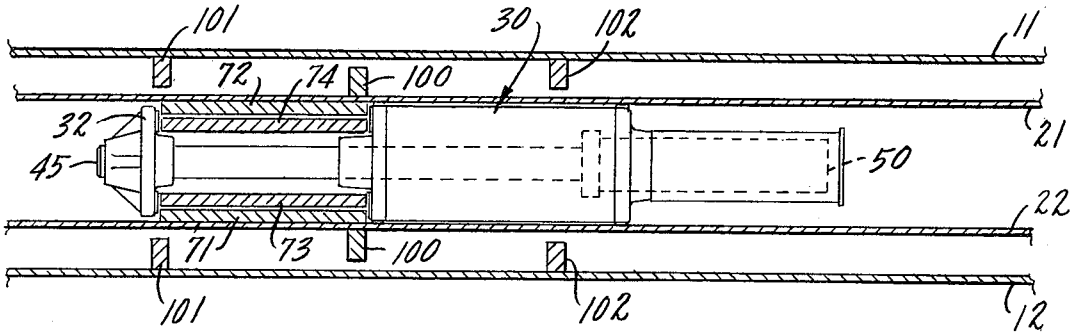

FIG. 6 is a plan view with certain parts broken away illustrating the hydraulic cushioning device in neutral position.

Figure 7:
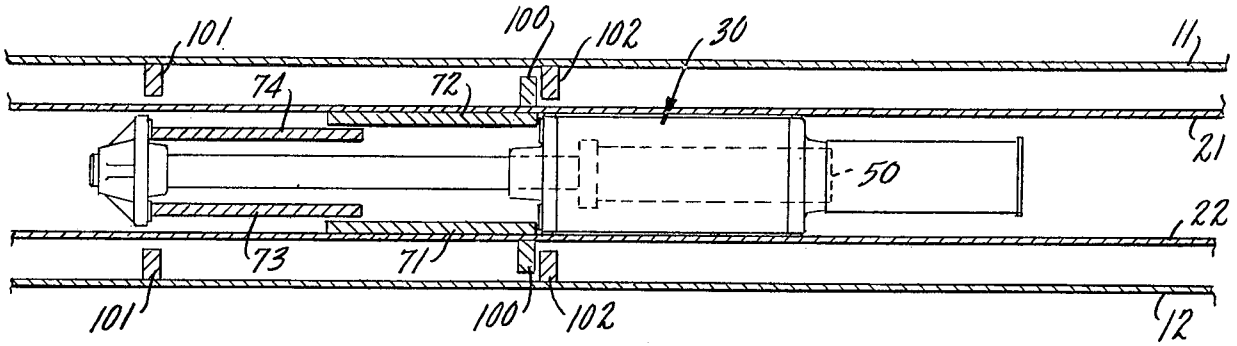

FIG. 7 is a plan view similar to FIG. 6 but illustrating the hydraulic cushioning device in an extended condition after being impacted from the left.

Figure 8:
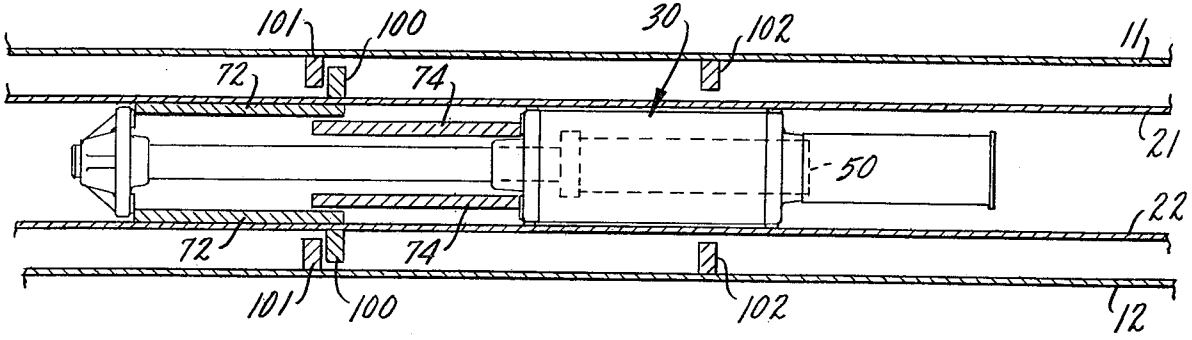

FIG. 8 is a view similar to FIG. 6 but showing the condition of the device after being impacted from the right.

Figure 1:
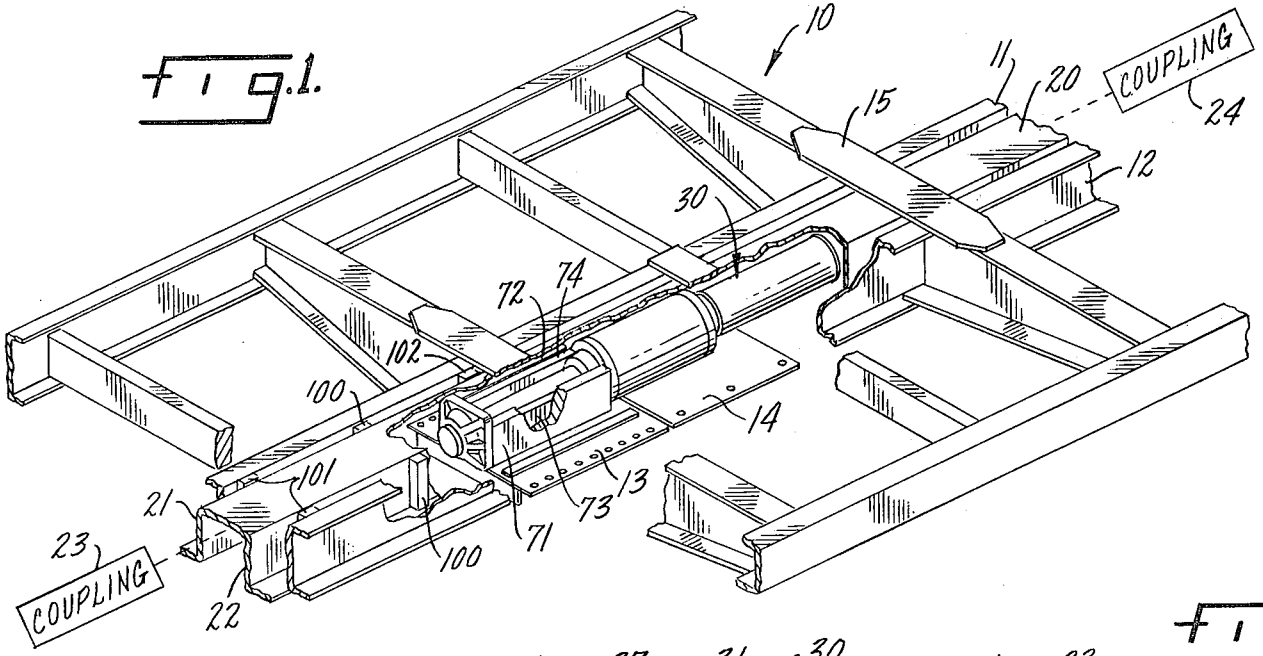
FIG. 1 is a perspective view of an hydraulic cushioning device comprising the present invention and positioned between the under frame and sliding center sill of a railway car, with certain parts broken away.

Referring now to the drawings, and particularly to FIG. 1, there is shown a railway car under frame 10 consisting of longitudinal and cross members. Extending centrally through the frame from one end to the other is a sill receptacle formed of a pair of sill members 11, 12 fixed parallel to one another bridged on the under side by plates 13, 14 and on the top by cross members 15. Such members define a passageway of rectangular cross section for housing a sliding sill member 20 of inverted channel shape having downwardly facing flanges 21, 22 and supporting couplings 23, 24 at its ends, the latter being shown only diagrammatically.

Figure 2:
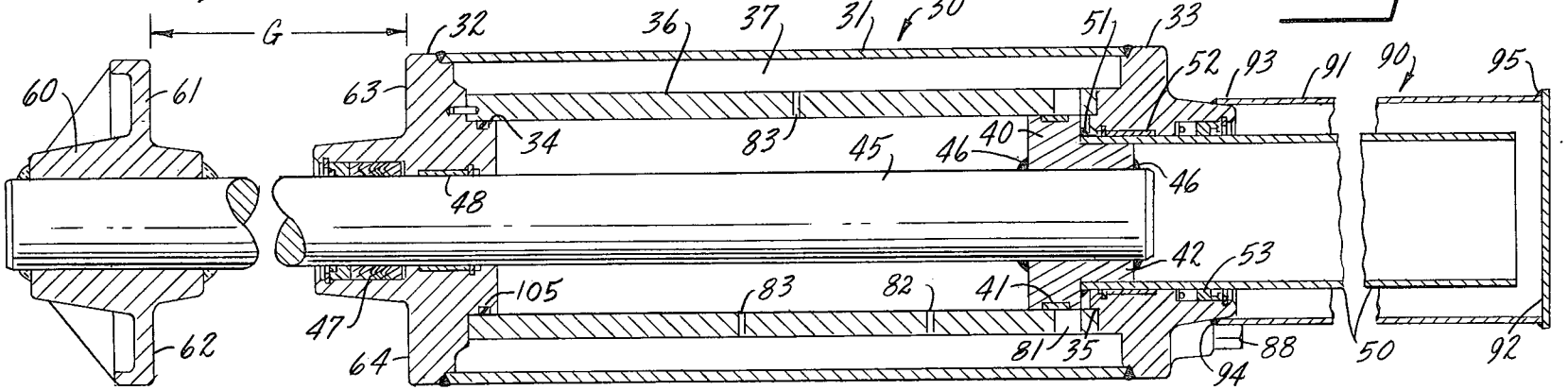
FIG. 2 is a longitudinal sectional view of the cushioning device of FIG. 1.

Located at the center of the car, and nested in the hollow of the sliding sill member 20 is a cushioning assembly 30 shown more specifically in FIG. 2, the purpose of which is to provide a shock-absorbing connection between the frame of the car and the couplings at either end.

The cushioning assembly includes an outer cylinder 31 which is connected at its ends to respective first and second end caps 32, 33 of generally annular shape, the cylinder and end caps being economically joined by continuous welds for strength and to prevent leakage. Extending between shoulders 34, 35 on the same end caps and enclosed by the outer cylinder is an inner or metering cylinder 36, the two cylinders defining an annular reservoir 37.

Slidable in the metering cylinder is a piston 40 of annular shape having a piston ring 41 and a coaxial hub portion 42 of reduced diameter. The piston has a first or main piston rod 45 snugly telescoped into it and secured by means of welds 46. The main piston rod is telescoped through the central opening in the end cap 32, being sealed with respect thereto by high pressure seals 47, 48.

A second piston rod 50, in the form of a thin-walled tube, is connected to the other side of the piston in alignment with the first piston rod. The second piston rod is, in turn, telescoped snugly over the reduced end portion 42 of the piston 40, being welded in place along a circular weld 51. The two piston rods are therefore in overlapping relation to secure coaxiality. The piston rod 50 extends through the central opening in the second end cap 33, being sealed with respect thereto by seals 52, 53.

For coupling the main piston rod to both the sill and the frame, the piston rod carries, at its end, a head 60 of square configuration dimensioned to nest within the sill 20 and having inwardly facing abutment surfaces 61, 62. The first end cap is formed to present cooperating abutment surfaces 63, 64, respectively. These abutment surfaces mutually define a gap having an axial length G when the piston and main piston rod are in the illustrated retracted position.

Stop members are provided on the sill and frame, respectively, for occupying the gap G, the stop members being provided in two pairs respectively connected to the sliding sill and frame. Referring to FIGS. 3 and 4, the stop members associated with the sliding sill are indicated at 71, 72, being connected thereto by welding, while those secured to the frame are shown at 73, 74. The latter are anchored, preferably by welding, to the bottom plate 13 which is mounted by bolts 13*a* to the stationary sill members 11, 12.

The stop members 71–74 are preferably in the form of rectangular plates all of which are dimensioned to fill the gap G with their ends opposed to the abutment surfaces 61–64, in register with one another. As a result, a shock to either one of the couplings 23, 24 at the ends of the sliding sill results in endwise movement of the sill with respect to the frame. Sill movement in either direction causes the stop members thereon to shift out of their initially registered condition with respect to the fixed stop members thereby to elongate the gap G so as to apply tension to, and extend, the main piston rod 45.

In carrying out the present invention metering orifices are provided in the metering cylinder, and both the metering cylinder and the reservoir which surrounds it are charged with a combination of hydraulic fluid and a non-condensing dry gas such as nitrogen or air. Specifically, metering orifices indicated at 81–83 are distributed progressively along the length of the cylinder and may be distributed also in the peripheral direction. Return orifices 81 are, as shown, immediately adjacent the back of the piston when it is in the illustrated neutral, or rest, position. As a result, when the piston rod 45 is tensioned, and thus extended, by a shock, fluid restrictedly flows through the metering orifices from a position in front of the piston through the reservoir 37 to a position behind the piston to absorb the shock.

In accordance with one of the features of the present invention the second piston rod 50 is formed of a thin-walled hollow tube having a substantially greater diameter than the main piston rod 45. The wall of the tube forming the second piston rod is smoothly continuous and impervious, that is, free of any perforation or other opening, so that the space within the second piston rod is isolated from the inner and outer cylinders in all positions of the piston. The second piston rod being of greater diameter presents a greater axially projected area to the pressurized fluid, with the result that, following the shock, the pressurized gas tends promptly to return the first piston rod to the retracted state in preparation for a subsequent shock. It is found that in a practical case a pressure on the order of 500 to approximately 700 pounds per square inch is adequate to bring about a prompt return and to hold the first piston rod in neutral position under normal running conditions, with the car either loaded or unloaded. In a normal filling procedure hydraulic fluid is admitted to the cushioning device in an amount which will occupy approximately eighty-five percent of the internal volume, the fluid being admitted to the reservoir through an opening which is normally closed by a threaded plug 84 (see FIGS. 5 and 5*a*). Nitrogen, preferably in the dry state, is subsequently added to the reservoir by a tube 85 through an air valve 86 of conventional type protected by a valve cap 87 and protector cap 88 (see also FIG. 5*b*). The fluid opening and the air line are, for purposes of checking and replenishment, located side by side along the lower edge of the end cap 33, conveniently accessible from the under side of the car, unbolting plate 14, if desired.

To facilitate filling the unit with hydraulic fluid to proper level, and for subsequently checking the level, the fill tube 85 preferably terminates in a riser tube 89 (FIG. 5) which extends upwardly along a curved path at the end of the reservoir to the desired liquid level indicated at L. In filling or adding oil the caps and valve at the air tube are removed; the plug 84 is removed and replaced by a fluid fill line (not shown). Hydraulic fluid is added until it overflows through the riser tube and out the air opening. When overflow is noted, as a telltale, the gas valve is screwed into place and gas is then added to the desired pressure level. In a typical situation gas may be added to a gauge pressure of 650 pounds per square inch. Since a certain amount of the gas will become dissolved in the hydraulic fluid the pressure will subsequently fall and stabilize at a working level of 525 pounds per square inch. In a unit of typical size such pressure will result in an average return force on the order of 10,000 pounds which is almost double that obtained in a comparable cushioning mechanism of the type employing a return spring.

The riser tube 89 is also useful in replenishing the oil to proper level as a result of regular maintenance. As a first step in this procedure the pressurized gas is vented and the unit is allowed to stand to rest for several hours, long enough to permit the dissolved gas to escape. An auxiliary source of fluid is connected to the fill opening, the check valve is removed from the air opening and fluid is admitted until overflow is noted, at which time the valve is replaced and the unit is re-pressurized.

In accordance with one of the aspects of the present invention the second piston rod is surrounded by a protective cup which is coaxial with the rod, the lip of the cup being secured to the second annular end cap by welding or the like. Thus we provide a cup 90 having a cylindrical wall 91, an outer cap 92 and a lip 93, the length and diameter of the cup being sufficient to clear the second piston rod both radially and axially when it is in the illustrated (FIG. 2) extended condition. The cup performs the dual function of protecting the tubular piston rod from deformation and abrasion and protecting both the rod and the seal against contamination and corrosion by a combination of moisture and dirt. The weld at the lip of the cup, indicated at 94, is preferably continuous to form a perfect seal at this point. However, the weld 95 which retains the cap 92 is preferably interrupted, resulting in a seam which, while closely fitted, permits slow leakage and, being distributed over some inches of length, acts as a filter to retain dirt particles on the outside of the cup. The intentional restricted venting of the cup insures that any leakage of the compressed gas which might occur through the seals 52, 53 will not be capable of producing a sustained build-up of pressure in the cup which would tend to defeat the gas restoration of the piston to its neutral, or start, position.

It is one of the features of the construction that "breathing" of air into and out of the cup as a result of shock is minimized. This is because the tube 50, which forms the second piston rod, is hollow, thin-walled and open at its outer end so that the pressure in the cup changes only slightly as the piston moves between its retracted and extended positions. This reduced "breathing", in turn, reduces the amount of moisture which tends to be drawn into the cup.

For maximum reliability and freedom from corrosion the outer surface of the tube 50 is preferably chromium plated, although it is one of the features of the present invention that, because of the protection which the cup 90 affords, the expense of chromium plating may be saved without appreciably shortening the life of the engaged seals. Chromium plating is, however, prescribed for the main piston rod 45 since it occupies a more exposed position. Experience shows that a less elaborate seal may be employed at position 47 than actually shown; specifically the type of seal shown at 53 may be substituted therefor with a consequent saving in cost.

While the protective cup 90 may be made of relatively thin material it is, nevertheless, because of its cylindrical shape and firm anchoring to the end cap, exeedingly strong; it is, for example, capable of withstanding rough engagement by a sling chain or the like when the unit is transported, treatment which would result in deformation or abrasion of the tube 50 if left unprotected, treatment which would certainly affect the integrity of the low pressure seal.

It is one of the features of the present construction that it may be employed universally, and with equal success, in cars having a wide range of size and weight. To obtain any desired shock absorption characteristic all that is required is to substitute a metering cylinder 36 having a different size and arrangement of metering holes 81–83, a matter well within the skill of the art and which, if desired, be determined empirically.

The unit, while appearing to be of monolithic construction, is nevertheless easily disassembled, should it be necessary to replace the metering cylinder or a seal, by chucking the unit and turning out the weld at one end of the outer cylinder, the weld being subsequently easily replaced.

It will be apparent that the construction amply meets all of the objects set forth above. It is simple and inherently lighter in weight than prior constructions, easily fabricated, yet durable and capable of withstanding continued rough usage in the field. It is capable of operating over long periods of time with minimum maintenance. Checking or replenishment of fluid to the desired level, or bringing the gas pressure up to a specified level, are easily accomplished with the device in place. Alternatively, the unit may be easily removed, by loosening a few bolts, for maintenance on the bench. Because of its design and built-in protective features the unit is capable of operating reliably even in the face of mistreatment.

While the stop members 71–74 are each in the form of a single plate of metal, with each presenting its ends to the abutment surfaces, it will be apparent that the stop members may be centrally relieved or formed of two separated end portions without departing from the present invention.

The construction and operation has been described above without reference to end stops for limiting the motion of the sliding sill. It will be understood that use of limit stops is a matter well within the skill of the art. Thus limit stops 100 may be welded to the sides of the sliding sill (FIGS. 1, 6, 7 and 8) cooperating with stops 101, 102 welded to the inner surfaces of the stationary sill members 11, 12, for limiting motion in the left and right-hand directions, respectively.

One of the aspects of the present invention has to do with the practical manufacture of the cushioning device described above. It may be noted in FIG. 2 that the first end cap 32 is formed with a shoulder 34 forming a cylindrical mounting surface and that the metering cylinder is telescoped over such mounting surface to form a joint. To achieve a seal at the joint the mounting surface has an outwardly facing groove formed therein. A sealing ring, indicated at 105, is seated in the groove, such sealing ring being made of stiff material such as cast iron and, similarly to an automotive piston ring, interrupted and biased for outward expansion against the inner wall of the metering cylinder. The sealing ring thus not only provides a high pressure seal at the joint but accommodates outward expansion of the metering cylinder as the fluid therein is subject to peak pressure as a result of a severe shock. In carrying out the present invention the metering cylinder, in the region of the joint, has an inner diameter greater than the outer diameter of the mounting surface so that if there is any misalignment between the piston axis and the axis of the cylinder mounting surface as the piston moves toward the end of its stroke, which might cause one side of the piston to crowd against the presented inner wall of the cylinder, the cylinder is free to accommodate the misalignment by lateral shifting in the required direction with respect to the shoulder 34 while, at the same time, maintaining a constant seal at the joint. While the cylinder 36 is, as shown, pinned against relative rotation, the pin is preferably loose so as to permit the required relative movement.

Thus while the joint at shoulder 34 is a simple form of telescoped slip joint, it maintains its sealing integrity in spite of momentary expansion of the cylinder in the face of peak pressure and in spite of cumulative alignment error during the course of manufacture. Moreover, the joint permits less expensive steel to be employed for the metering cylinder than would otherwise be required, resulting in further economy. In a practical case the inner diameter of the cylinder 36 may be made "oversize" by approximately 0.030 inch.

What is claimed is:

1. In a railway car having a frame and a slideable sill extending therethrough for interconnecting the couplings at the ends of the car, a cushioning assembly comprising, in combination, an outer cylinder, first and second annular end caps sealed to the ends of the cylinder, an inner metering cylinder extending between the end caps and spaced uniformly inwardly from the outer cylinder to define an annular reservoir therebetween, a piston slideable in the metering cylinder, a first piston rod extending from one side of the piston and having a sealed telescopic connection with the first annular end cap, a second piston rod in the form of a hollow thin-walled tube connected to the other side of the piston in alignment with the first piston rod, said second piston rod having a sealed telescopic connection with the second annular end cap, the wall of the tube forming the second piston rod being smoothly continuous and impervious so that the space within the second piston rod is isolated from the inner and outer cylinders in all positions of the piston, the first piston rod having a head at its outer end, the head and the first end cap presenting opposed abutting surfaces facing mutually inwardly to define an axial gap between them when the first piston rod is in its contracted state, stop members on the sill and the frame respectively normally positioned side by side in register with one another and both dimensioned to fill the gap between the abutting surfaces so that a shock to either one of the couplings resulting in endwise movement of the sill with respect to the frame in either direction causes the stop members to shift out of register with one another thereby to elongate the gap so as to tension and extend the first piston road, a pressurized mixture of hydraulic fluid and pressurized gas in the metering cylinder and reservoir, a set of metering orifices distributed along the length of the metering cylinder so that as the first piston rod is extended by the shock the mixture restrictedly flows through the metering orifices from a position in front of the piston through the reservoir to a position behind the piston thereby cushioning the shock, the second piston rod having a substantially greater diameter than the first piston rod so that the second piston rod presents a greater axially projected area to the pressurized mixture with the result that following the shock the pressurized mixture tends promptly to return the first piston rod to the retracted state in readiness for a subsequent shock.

2. The combination as claimed in claim 1 including an elongated protective cup surrounding and coaxial with the second piston rod, the lip of the cup being rigidly secured to the second annular end cap for protecting the wall of the tube against deformation and entry of dirt and moisture.

3. The combination as claimed in claim 2 the cup being filled with air, the tube being open-ended and the wall of the tube being sufficiently thin so that the pressure in the cup changes only slightly as the second piston rod moves between its retracted and extended positions.

4. The combination as claimed in claim 2 in which the cup has a restricted vent opening to prevent any sustained build-up of pressure therein above the atmospheric level.

5. The combination as claimed in claim 1 in which the piston has a coaxial hub portion of reduced diameter, the piston being snugly telescoped over the end of the first piston rod and secured thereto, the second piston rod being in turn snugly telescoped over the hub portion of the piston and secured thereon so that the two piston rods are in overlapping relation thereby to insure coaxiality.

6. The combination as claimed in claim 1 in which separate fluid and gas fill openings penetrate in the second end cap to provide communication with the reservoir, the gas fill opening being sealed by a check valve, the fill openings being arranged side by side along the bottom edge of the end cap for convenient access for purposes of checking and replenishment.

7. The combination as claimed in claim 6 in which the gas fill opening communicates with a riser tube which extends upwardly to the desired fill level and in which the check valve is removable so that the fluid which overflows upon exceeding the fill level as fluid is added through the fluid fill opening serves as a telltale that the desired level has been reached.

8. The combination as claimed in claim 1 in which the first end cap has an annular shoulder forming a cylindrical mounting surface over which the end of the metering cylinder is telescoped to form a joint, the cylindrical mounting surface having an outwardly facing groove formed therein, a sealing ring seated in the groove, said sealing ring being made of stiff material interrupted and biased for outward expansion against the inner wall of the metering cylinder for providing a high pressure seal at the joint and to accommodate outward expansion of the metering cylinder as the fluid therein is subject to peak pressure as a result of shock, the inner diameter of the metering cylinder being greater than the outer diameter of the mounting surface so that any misalignment between the piston axis and cylinder axis as the piston moves in the rod-extending position is accommodated by lateral shifting of the cylinder with respect to the mounting surface while maintaining a seal at the joint.

* * * * *